US012279730B2

(12) United States Patent
Vaughn et al.

(10) Patent No.: US 12,279,730 B2
(45) Date of Patent: Apr. 22, 2025

(54) PERSONAL CLEANING DEVICE

(71) Applicants: Tierre Vaughn, Indianapolis, IN (US); Albert Vaughn, Indianapolis, IN (US)

(72) Inventors: Tierre Vaughn, Indianapolis, IN (US); Albert Vaughn, Indianapolis, IN (US)

( * ) Notice: Subject to any disclaimer, the term of this patent is extended or adjusted under 35 U.S.C. 154(b) by 380 days.

(21) Appl. No.: 17/670,806

(22) Filed: Feb. 14, 2022

(65) Prior Publication Data

US 2022/0265096 A1 Aug. 25, 2022

Related U.S. Application Data

(60) Provisional application No. 63/152,288, filed on Feb. 22, 2021.

(51) Int. Cl.

| | |
|---|---|
| ***A47K 7/04*** | (2006.01) |
| ***A46B 5/00*** | (2006.01) |
| ***A46B 11/06*** | (2006.01) |
| ***A46B 13/00*** | (2006.01) |
| ***A46B 13/04*** | (2006.01) |
| ***A46B 15/00*** | (2006.01) |

(52) U.S. Cl.

CPC ..... *A47K 7/04* (2013.01); *A46B 5/0004* (2013.01); *A46B 5/0095* (2013.01); *A46B 11/06* (2013.01); *A46B 13/008* (2013.01); *A46B 13/04* (2013.01); *A46B 15/0004* (2013.01); *A46B 2200/1006* (2013.01)

(58) Field of Classification Search

CPC ... A46B 5/0004; A46B 5/0095; A46B 13/008; A46B 13/04

See application file for complete search history.

(56) References Cited

U.S. PATENT DOCUMENTS

| | | | | |
|---|---|---|---|---|
| 4,417,362 | A * | 11/1983 | Walker | A47K 7/024 15/210.1 |
| 5,345,640 | A * | 9/1994 | Goss | A47K 7/04 4/606 |
| 5,561,869 | A * | 10/1996 | Sarel | A47K 7/046 4/606 |
| D409,337 | S * | 5/1999 | Johnson, Jr. | D28/63 |
| 6,996,861 | B1 * | 2/2006 | Clark, Jr. | A47K 7/04 4/606 |
| 7,120,947 | B1 * | 10/2006 | Magallanes | A47K 7/03 601/134 |
| 7,175,357 | B1 * | 2/2007 | Brignoni | A46B 11/0041 4/606 |
| 7,434,287 | B1 * | 10/2008 | Borges | A47K 7/024 4/606 |
| 7,451,513 | B2 * | 11/2008 | Torres | A47K 7/024 4/606 |

(Continued)

*Primary Examiner* — Marc Carlson

(74) *Attorney, Agent, or Firm* — Brennan, Manna & Diamond, LLC

(57) ABSTRACT

The present invention relates generally to the field of personal cleaning devices having a housing with a front surface with at least one brush and a rear surface with at least one attachment feature for attachment to a surface such as a shower wall. The brush is powered by a motor which causes the brush to spin or move in different directions. The device may also have a soap dispenser that dispenses soap or other liquids which can be applied to the brush before use. The motor may further have a plurality of speeds and can be configured to run for a fixed period of time.

18 Claims, 6 Drawing Sheets

(56) References Cited

U.S. PATENT DOCUMENTS

| | | | | |
|---|---|---|---|---|
| 8,272,799 | B1 * | 9/2012 | Yard | A47K 7/024 4/606 |
| 8,458,840 | B2 * | 6/2013 | Galindo Sanchez | A61H 7/004 4/606 |
| 8,621,679 | B1 * | 1/2014 | Donikian | A47K 7/024 4/606 |
| 9,271,614 | B2 * | 3/2016 | Rowles | A47K 7/024 |
| D776,353 | S * | 1/2017 | Jones | D28/63 |
| 9,826,863 | B1 * | 11/2017 | Watson | A47K 7/024 |
| 10,646,077 | B2 * | 5/2020 | Bear | A47K 7/024 |
| 10,660,484 | B1 * | 5/2020 | Okuszka | A47K 7/04 |
| 11,122,941 | B2 * | 9/2021 | Palacios | A46B 17/02 |
| 11,166,603 | B1 * | 11/2021 | Smith | A46B 13/008 |
| 11,399,670 | B1 * | 8/2022 | Orange | A47K 7/03 |
| 2005/0229347 | A1 * | 10/2005 | Dent D'Almuano | A47K 7/024 4/606 |
| 2006/0107473 | A1 * | 5/2006 | Torres | A47K 7/024 4/606 |
| 2009/0113616 | A1 * | 5/2009 | Daly, Sr. | A46B 11/0058 4/606 |
| 2016/0088927 | A1 * | 3/2016 | Knight | B25G 1/04 15/4 |
| 2016/0143489 | A1 * | 5/2016 | Grossman | A47K 7/04 4/606 |
| 2017/0332849 | A1 * | 11/2017 | Morris | A47K 7/024 |
| 2018/0153280 | A1 * | 6/2018 | Ostrander | A45D 42/14 |
| 2019/0174970 | A1 * | 6/2019 | Zohrabian | A47K 7/04 |

* cited by examiner

PERSONAL CLEANING DEVICE

CROSS-REFERENCE TO RELATED APPLICATION

The present application claims priority to, and the benefit of, U.S. Provisional Application No. 63/152,288, which was filed on Feb. 22, 2021, and is incorporated herein by reference in its entirety.

FIELD OF THE INVENTION

The present invention relates generally to the field of personal care accessories. More specifically, the present invention relates to a back scrubbing device having a body with a front surface having at least one brush and a rear surface with at least one fastener for securing the invention. The device can be attached to a surface such as a shower wall or other area where it may be useful to engage in personal care activities via the at least one fastener. The one or more brushes is further powered by a motor which causes each of the brushes to spin. As a result, a user can place his or her back adjacent to the device while standing, such that the brush or brushes washes and cleans the back. The device may also include a soap dispenser that dispenses soap or other liquids which can be applied to the brush or brushes before use to aid in the cleansing activity. The motor may further have a plurality of speeds and can be configured to run for a fixed or pre-set period of time. Accordingly, the present disclosure makes specific reference thereto. Nonetheless, it is to be appreciated that aspects of the present invention are also equally applicable to other like applications, devices and methods of manufacture.

BACKGROUND

Personal hygiene is important to most individuals, and as a result nearly all individuals bathe regularly. However, many individuals may have difficulty adequately reaching and washing all areas of their body such as their back while bathing or cleaning. This inability can be due to a number of factors, which include limited flexibility, age, size, dexterity and other limitations. This is undesirable, as failure to adequately wash the skin of one's back can lead to skin conditions, acne and an undesirable smell. Tools such as loofahs, washcloths and back scrubbers exist in the art, and each of these devices attempt to aid a user in washing his or her back or other difficult to reach areas. However, these devices are handheld, such that they still require a significant amount of flexibility and dexterity that all users may not possess.

Therefore, there exists a long-felt need in the art for an improved personal cleaning device to reach difficult areas of one's body. There also exists a long-felt need in the art for a back scrubbing device that allows a user to wash his or her back or other difficult to reach areas without requiring significant flexibility, age, size or dexterity. Further, there exists a long-felt need in the art for a back scrubbing device that does not require a user to use the hands or a handheld tool to wash the back or other difficult to reach areas.

The subject matter disclosed and claimed herein, in one embodiment thereof, comprises a back scrubbing device. The device has a housing or body with a front surface having at least one brush and a rear surface with at least one fastener or attachment feature. The device can be attached to a surface such as a shower wall or other area via the at least one fastener or attachment feature. The brush or brushes is further powered by a motor which causes the brush or brushes to spin, move back and forth, side to side and up and down. As a result, a user can place the back onto or adjacent to the device while standing, such that the brush washes the back. The device may also include one or more soap or other fluid dispensers that dispenses soap or other liquids which can be applied to the brush before use. The motor may further have a plurality of speeds and can be configured to run for a fixed period of time.

In this manner, the personal cleansing accessory of the present invention accomplishes all of the forgoing objectives and provides an improved back scrubbing device. The device allows a user to wash his or her back without requiring significant flexibility, age, size or dexterity. Further, the device does not require a user to use the hands or a handheld tool to wash his or her back.

SUMMARY OF THE INVENTION

The following presents a simplified summary in order to provide a basic understanding of some aspects of the disclosed innovation. This summary is not an extensive overview, and it is not intended to identify key or critical elements or to delineate the scope thereof. Its sole purpose is to present some general concepts in a simplified form as a prelude to the more detailed description that is presented later.

The subject matter disclosed and claimed herein, in one embodiment thereof, comprises a personal cleaning device. The invention has a housing or body that includes a front surface with at least one brush and a rear surface with at least one fastener or attachment mechanism. In one embodiment of the device the housing or body, and a neck extension that may attach to the body, are manufactured from a durable metal or a flexible, semi-rigid or rigid plastic. In a flexible or semi-rigid embodiment, the front surface may deform to accommodate the shape of the back and neck of a user when a user's back and neck contacts the front surface during use. In a rigid embodiment, the front surface of the body and the front surface of the neck extension may be convex or concave shaped in order to oppose or receive the shape of a back of a user.

The body or housing has a front surface, a rear surface, a pair of side surfaces, a top surface and a bottom surface. The front surface includes at least one bristled brush that may be fixedly or removably attached to the front surface. Brushes may have different shapes and textures and may be in a fixed position or may move. The brush or brushes may vary in different embodiments such that it may be any shape, texture (i.e., soft or coarse bristles), color, material, etc. The top surface of the body may further receive a neck extension that may be repositionable to accommodate the neck shape and position of the user. The front surface of the neck extension further includes at least one brush of the same or differing type as the body.

The brushes are further in electrical communication with at least one motor stored within the body or housing. The motor is further powered by at least one battery which can be replaced and accessed through at least one battery door that is preferably located on the side surface (or any other surface) of the body. The motor powers the brushes such that the brushes spin and move. The brushes may spin at any speed and may rotate any amount within a 360-degree range of movement. The brushes may move up and down, side to side, diagonally or in any other direction. The motor may have a plurality of speed levels that allow the brushes to rotate at specific speed levels (i.e., rotations per minute). The speed levels are further controlled by at least one button which can be set to have different speeds during operation of the brushes. The degree of rotation (i.e., 360 degrees or less) of the brushes may also be controlled by the button or a smartphone application which has software previously downloaded. The brushes and/or motor may further be configured using the button or smartphone to run for a fixed duration of time.

A control panel is further preferably located on one side surface of the body, where operational controls may be found on the control panel. At least one dispenser is further housed within the control panel. An opening further allows soap (or other liquid) within the dispenser and contained within a reservoir to be expelled via pressing the button which activates at least one pump that is powered by the motor. In this manner, a user can expel soap, bodywash, water, and other combinations. onto their hands and then onto the brushes before the invention is used.

The rear surface of the body and/or the rear surface of the neck extension further include at least one fastener or attachment device that allows the invention to be removably or fixedly secured to a surface such as, but not limited to: a bathroom wall or a shower wall or other suitable surface. As a result, the device can be suspended from the surface to be used. In differing embodiments, the fastener or attachment device may be any fastener known in the art such as, but not limited to, a suction cup, hook and loop, magnet, bolt, nut, screw, adhesive, etc.

To use the invention, a user can first secure the device to a surface using the fasteners at a height close to the height of their back from the ground. Then, the soap dispenser can be filled with a soap, body wash, or other liquid of choice of the user and the button can be pressed such that the motor is powered on and the brushes begin spinning or other movement. Then, a user backs up to the device such that their back (and in an embodiment of the device with a neck extension, their neck) contacts the front surface and brushes. The user can remain in contact with the front surface and brushes until the back and/or neck is adequately washed.

Accordingly, the personal cleaning device of the present invention is particularly advantageous as it allows a user to wash the back or other parts of their body without requiring significant flexibility, age, size or dexterity. Further, the device does not require a user to use their hands or a handheld tool to wash the back. In this manner, the personal cleaning device overcomes the limitations of existing methods of washing a back known in the art.

To the accomplishment of the foregoing and related ends, certain illustrative aspects of the disclosed innovation are described herein in connection with the following description and the annexed drawings. These aspects are indicative, however of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
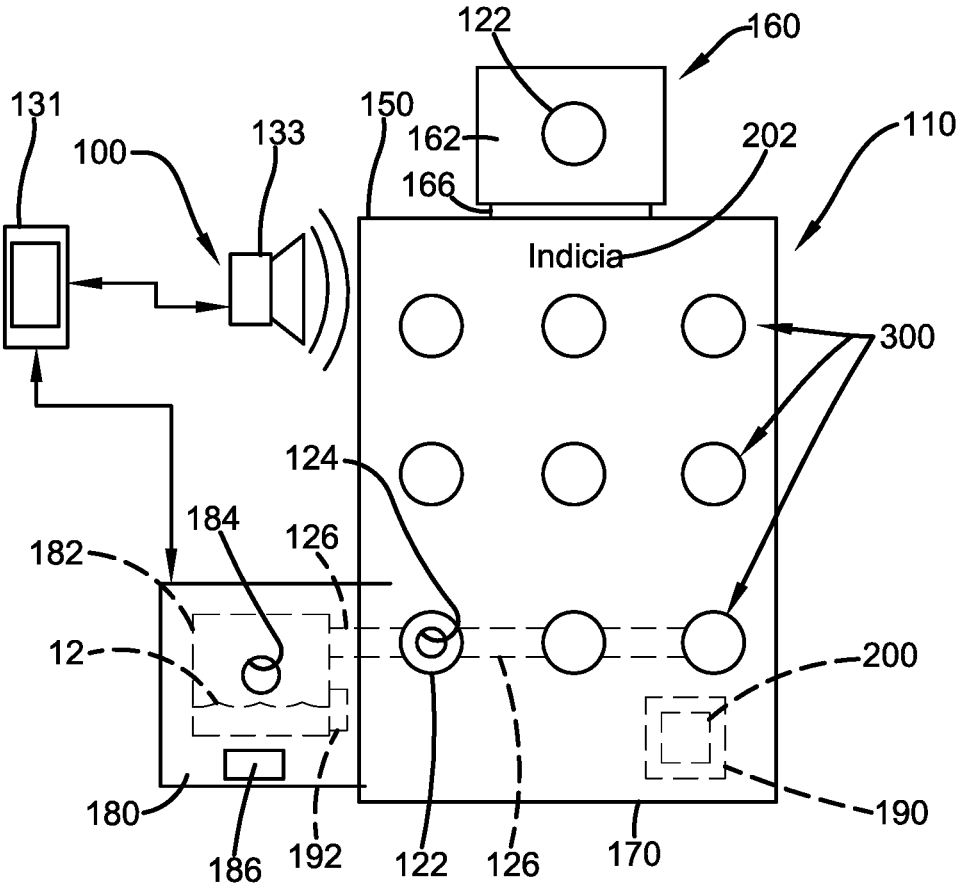
FIG. 1 illustrates a front view of one potential embodiment of a personal cleaning device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for an improved personal cleaning or back scrubbing device. There also exists a long-felt need in the art for a personal cleansing or back scrubbing device that allows a user to wash the back or other difficult to reach areas without requiring significant flexibility, age, size or dexterity. Further, there exists a long-felt need in the art for a personal scrubbing device that does not require a user to use their hands or a handheld tool to wash their back.

The present invention, in one exemplary embodiment, is comprised of a personal cleaning or scrubbing device having a housing or body which includes a front surface with at least one brush and a rear surface with at least one fastener or attachment feature. In order to be used, the device can be attached to a surface such as a shower wall via the at least one fastener. The brush or brushes of the device is further powered by a motor which causes the brush to spin and otherwise move such that a user can place their back or other portion of their body onto the device while standing such that the brush washes their back or body portion. The invention may also have a soap dispenser that dispenses soap or other liquids which can be applied to the brush or brushes before use. The motor may further have a plurality of speeds and directions and can be configured to run for a fixed period of time or alternatively, individual brushes may run at different periods of time.

Referring initially to the drawings, FIG. 1 illustrates a front view of one potential embodiment of a back scrubbing device 100 of the present invention in accordance with the disclosed specification. The device 100 includes a housing or body 110 with a front surface 120 with at least one brush 122 and a rear surface 130 with at least one fastener 132 or attachment feature. In one embodiment of the device 100 the housing or body 110, and a neck extension 160 that may attach to the body 110, are manufactured from a durable metal such as, but not limited to, stainless steel or aluminum. However, in a differing embodiment the housing or body 110 and neck extension 160 are manufactured from a deformable, flexible, semi-rigid or rigid plastic such as, but not limited to, an acrylic, polycarbonate, polyethylene, thermoplastic, acrylonitrile butadiene styrene, low density polyethylene, medium density polyethylene, high density polyethylene, polyethylene terephthalate, polyvinyl chloride, polystyrene, polylactic acid, acetal, nylon, fiberglass, recycled plastic, biodegradable plastic, or combinations thereof. In a flexible or semi-rigid embodiment, the front surface 120 may deform or contour to and/or around the back and neck or other body portion of a user when a user's back and neck contacts the front surface 120 during use. In a rigid embodiment, the front surface 120 of the body 110 and the front surface 162 of the neck extension 160 may be convex or concave shaped in order to oppose or receive the shape of a back and/or neck of a user. The body 110 may further be any color in the art and may be transparent, semi-transparent or opaque. In addition, the body 110 may be comprised of a plurality of indicia 202 such as, but not limited to, patterns, logos, emblems, images, symbols, designs, letters, numbers, words, characters, animals, advertisements, brands, etc.

The body or housing 110 has a front surface 120, a rear surface 130, a pair of side surfaces 140, a top surface 150 and a bottom surface 170. In the preferred embodiment, the body or housing 110 is generally rectangular-shaped, but may be any shape known in the art such as, but not limited to, circular, triangular, square, etc. in differing embodiments. The front surface 120 has at least one brush 122 that is preferably bristled. In differing embodiments, the brush 122 may be fixedly or removably attached to the front surface 120. In the preferred embodiment, the front surface 120 has a plurality of brushes 122 arranged in a series of rows and/or columns. The brush or brushes 122 may vary in different embodiments such that it may be any shape, texture (i.e., soft or coarse bristles), color, material, shapes and the brushes may be applied in any configuration. The device 100 may also include a kit 300 of a plurality of brushes 122 that can be interchanged on the front surface 120, wherein each brush 122 may vary regarding shape, texture, color, material, etc.

The top surface 150 may further receive a neck extension 160. The neck extension 160 may be fixedly attached to the top surface 150 or may be removably attached to the top surface 150 of the housing 110 via at least one fastener 166 such as, but not limited to, a screw, bolt, tongue and groove, hinge, etc. In an embodiment wherein the neck extension 160 is connected via a hinge or fastener 166, the neck extension may be repositionable to accommodate the neck shape and position of the user. The front surface 162 of the neck extension 160 has at least one brush 122 of the same or differing type as the body or housing 110.

The brushes 122 of the device 100 are further in electrical communication with at least one motor 190 stored within the body or housing 110. The motor 190 is further powered by at least one battery 200. The battery 200 may be a disposable battery 200 or a rechargeable battery 200 in the form of an alkaline, nickel-cadmium, nickel-metal hydride battery 200, etc. such as any 3V-12 volts DC battery 200 or other conventional battery 200 such as A, AA, AAA, etc. that supply power to the device 100. Throughout this specification the terms "battery" and "batteries" may be used interchangeably to refer to one or more wet or dry cells or batteries 200 of cells in which chemical energy is converted into electricity and used as a source of DC power. References to recharging or replacing batteries 200 may refer to recharging or replacing individual cells, individual batteries 200 of cells or a package of multiple battery cells as is appropriate for any given battery 200 technology that may be used. The battery 200 can further be replaced and accessed through at least one battery door 142 that is preferably located on the side surface 140 (or any other surface) of the body 110. The motor 190 powers the brushes 122 such that the brushes 122 spin.

In differing embodiments, the brushes 122 may spin at any speed, may rotate within a 360-degree range of movement or may move up and down, side to side, diagonally or combinations thereof. The motor 190 have may a plurality of speed levels that allow the brushes 122 to rotate at specific speed levels (i.e., rotations per minute), or directions. The speed levels are further controlled by at least one button 186 or smartphone 131, which has a previously downloaded software program and is wirelessly connected to the motor and other control features of the device 100. The smartphone 131 may also be connected to a speaker 133 to allow a user to play music, listen to audio books, take a call or similar activities. The degree of rotation (i.e., 360 degrees or less) of the brushes 122 may also be controlled by the button 186 or smartphone 131. The brushes 122 and/or motor 190 may further be configured using the button 186 or smartphone to run for a fixed duration of time. In differing embodiments, the timed duration, speed, intensity and operation of the brushes may vary. The device 100 may further have a plurality of pre-set or pre-determined timed intervals that can be selected using the button 186 or smartphone to allow the brushes 122 to run for a specific period of time.

A control panel 180 is further preferably located on one side surface 140 of the body or housing 110, wherein the button 186 or smartphone may be found on the control panel 180. At least one soap or other material dispenser 182 is further housed within the control panel 180, and the soap dispenser 182 can be refilled by an opening 184 filling a reservoir that holds the liquid or soap. The opening 184 further allows soap (or other liquid) within the dispenser 182 to be expelled via pressing the button 186 which activates at least one pump 192 that is powered by the motor 190. In this manner, a user can expel soap, bodywash, water, liquid, etc. 12 onto their hands and then onto the brushes 122 before the device 100 is used.

In one embodiment, at least one piece of internal piping 126 is connected to the dispenser 182 and to at least one brush 122 within the body 110 such that the brush 122 and dispenser 182 are in fluid communication. In this embodiment, the at least one brush 122 is has at least one opening 124 located on the brush 122. In this manner, once the device 100 is powered on (by pressing the button 186 or activated by a smartphone), soap (or other liquid) is pumped via the pump 192 through the piping 126 and is expelled from the opening 124 in the brush or brushes 122 while the brush 122 rotates and scrubs the user's back. Therefore, a user need not manually apply soap to the brushes 122 before using the device 100.

Figure 2:
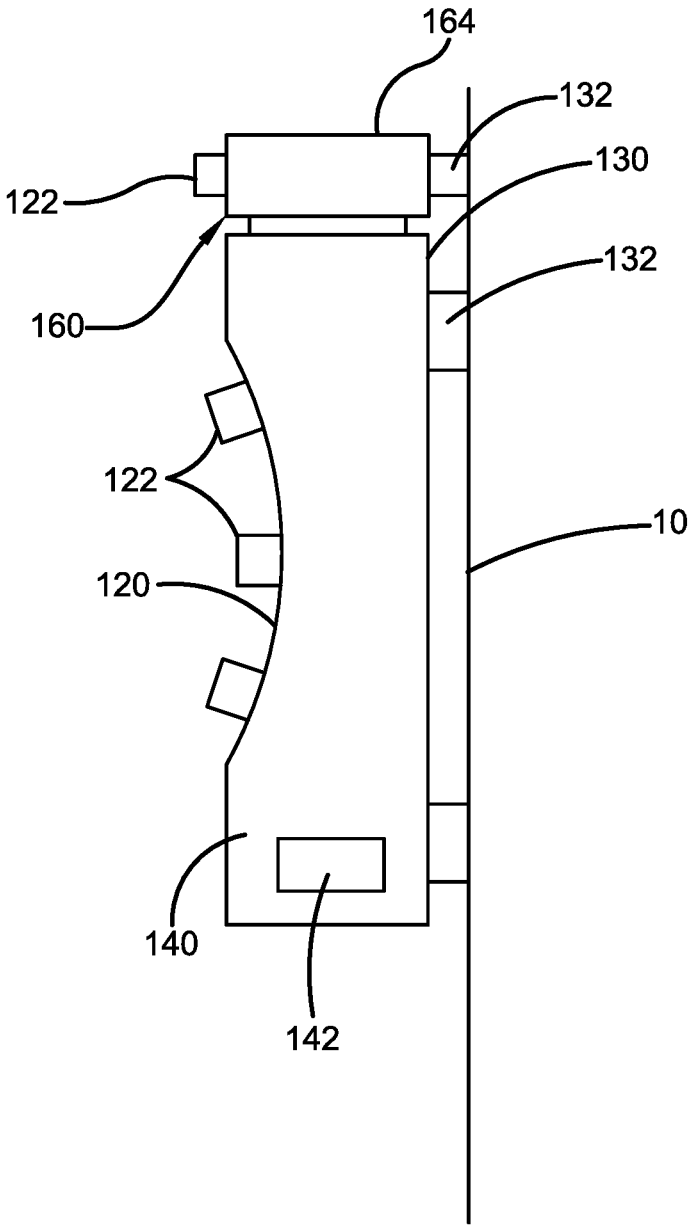
FIG. 2 illustrates a side view of one potential embodiment of a personal cleansing device of the present invention in accordance with the disclosed architecture.

FIG. 2 illustrates a side view of one potential embodiment of a personal cleaning or back scrubbing device 100 of the present invention in accordance with the disclosed specification. The rear surface 130 of the body 110 and/or the rear surface 164 of the neck extension 160 includes at least one fastener 132 that allows the device 100 to be removably or fixedly secured to a surface 10 such as, but not limited to, a bathroom wall, a shower wall, or other suitable surface. In this manner, the device 100 can be suspended from the surface 10 to be used. In differing embodiments, the fastener 132 may be any fastener 132 known in the art such as, but not limited to: suction cup, hook and loop, magnet, bolt, nut, screw, adhesive, etc.

To use the device 100, a user can first secure the device 100 to a surface 10 using the fasteners 132 at a height close to the height of the back or other body portion from the ground. The mounting feature may also allow adjustment or movement of the device 100 as will be further described herein. Then, the soap dispenser 182 can be filled with a soap, body wash, or other liquid 12 of choice of the user. Then, the button 186 can be pressed such that the motor 190 is powered on and the brushes 122 begin spinning, or other movement. In an embodiment wherein the brushes 122 expel soap or another liquid, the soap will then be expelled when the button 186 or activated by the smartphone 131 is pressed and the brushes begin to spin or move 122. Then, a user backs up to the device 100 such that the back (and in an embodiment of the device 100 with a neck extension 160, their neck) contacts the front surface 120, 162 and brushes 122. The user can remain in contact with the front surface 120, 162 and brushes 122 until the back and/or neck is adequately washed, or until the timed duration of brush 122 rotation has expired.

Figure 3:
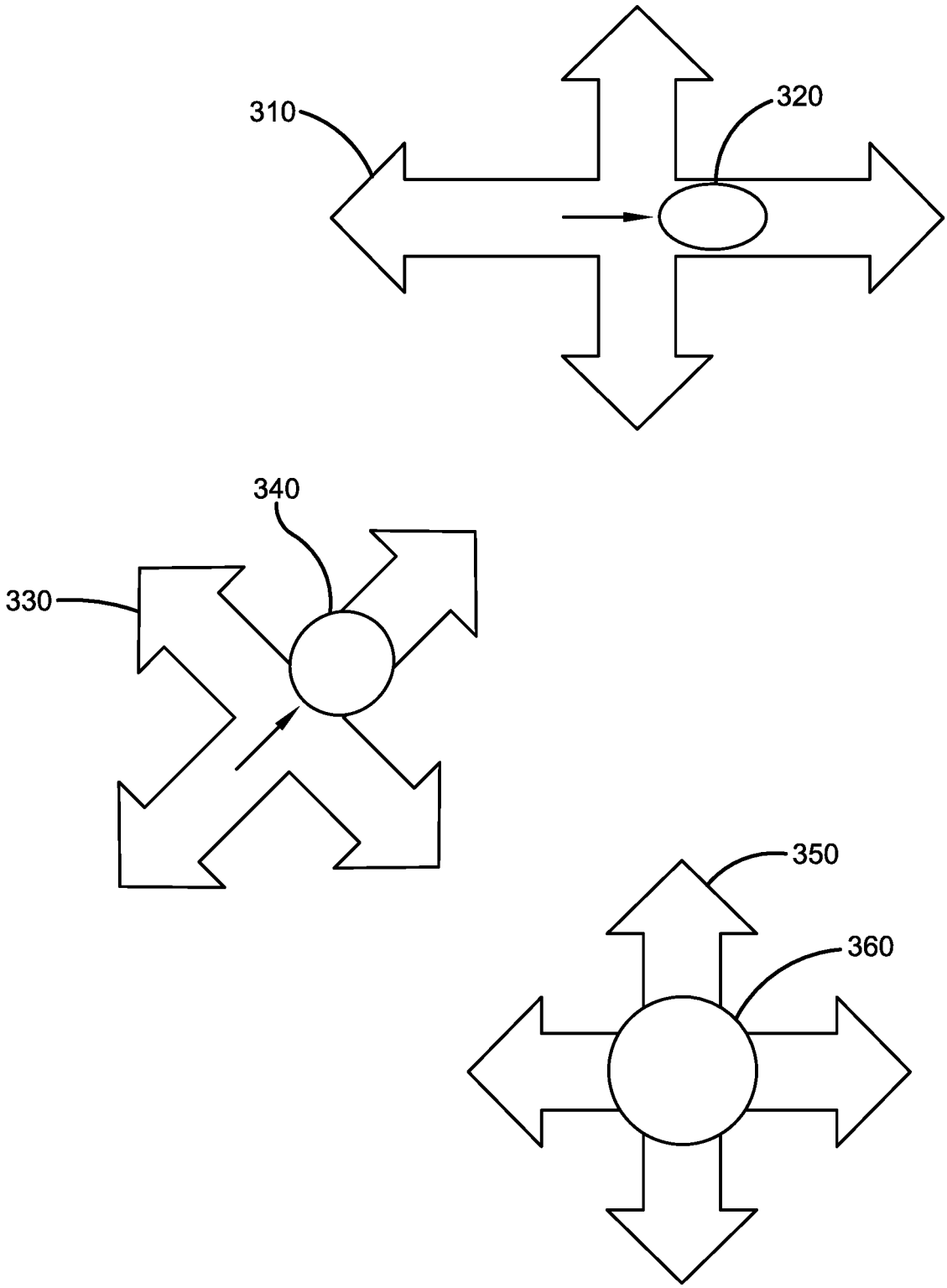
FIG. 3 illustrates a schematic of the directional travel of the brushes used with one potential embodiment of the personal cleansing device of the present invention in accordance with the disclosed architecture.

FIG. 3 is a schematic showing the direction of movement of the brushes. 310 provides a longer horizontal movement than a vertical movement of brush 320. 330 shows a brush 340 movement which occurs in equal directions and 350 provides a diagram of a diagonal movement of brush 360. Brushes 320, 340 and 360 are also shown as having different sizes.

Figure 4:
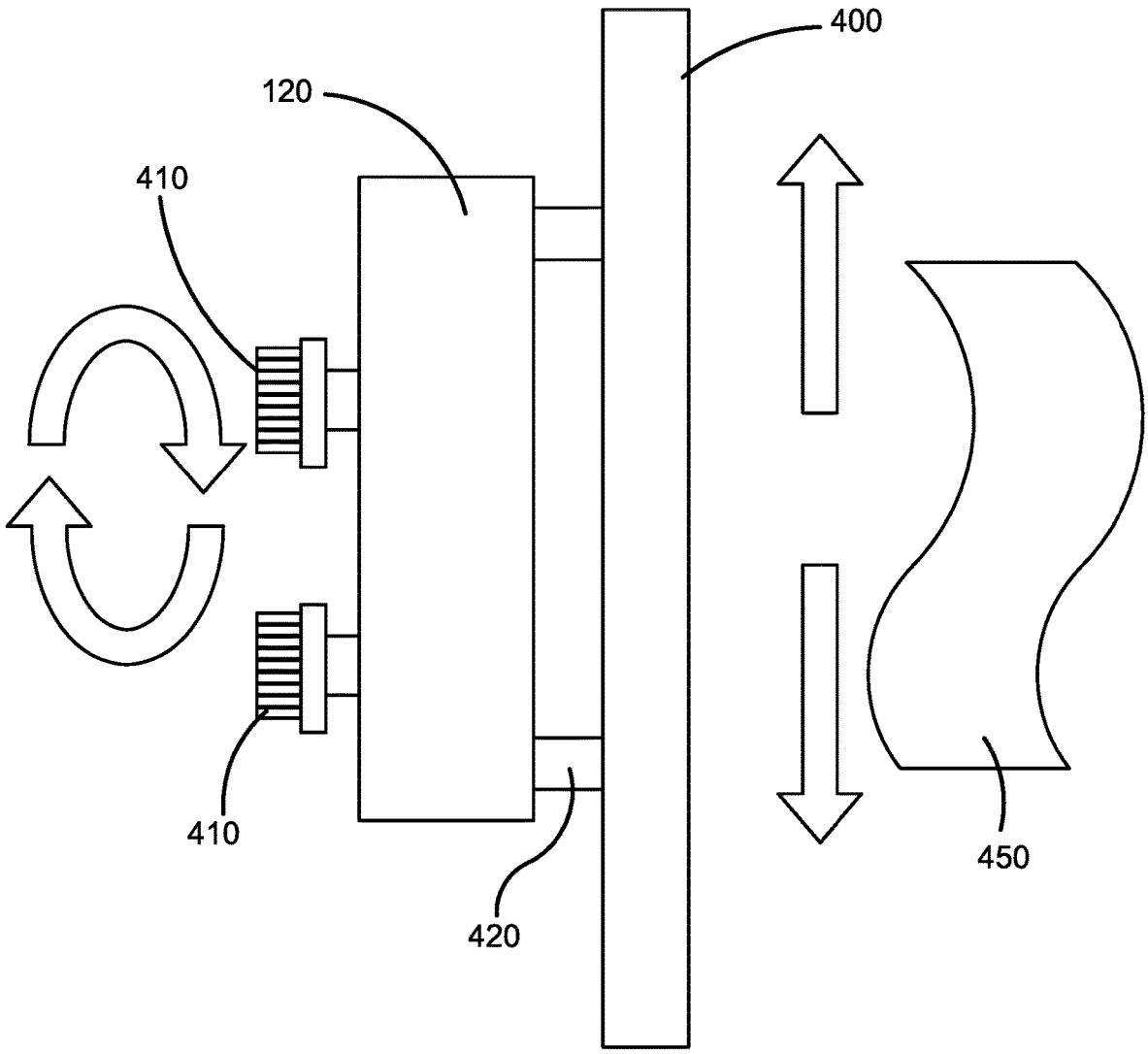
FIG. 4 illustrates a perspective view of one potential embodiment of the personal cleaning device of the present invention in accordance with the disclosed architecture.

FIG. 4 shows the housing 120 mounted to a surface 400 such as a wall by attachment features 420 which allow the housing and brushes 410 to move up and down in order to adjust to different sized individuals. In addition, FIG. 4 shows a deformable surface or shaped surface 450 allowing the housing to adjust to the shape of a particular body portion.

Figure 5:
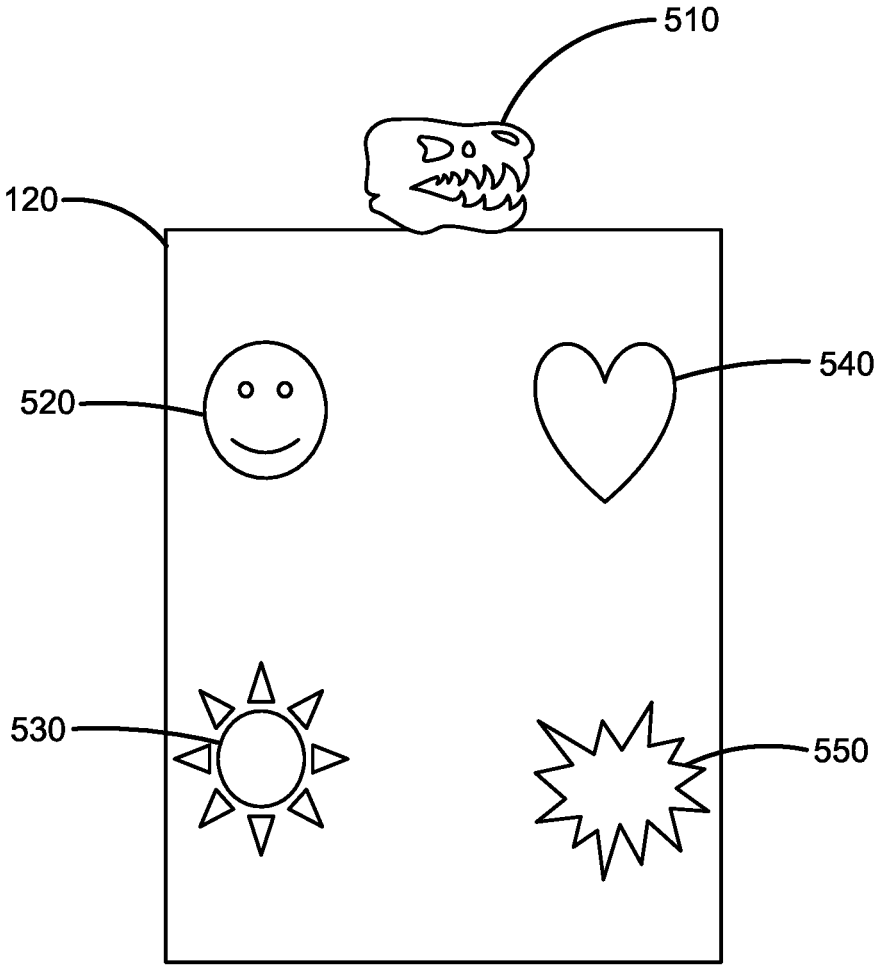
FIG. 5 illustrates a perspective view of various potential embodiments of different different brushes and other personalized features.

FIG. 5 shows the housing 120 having a decorative head mounted on the housing 510 to make the personal cleaning device more attractive to children. In addition, the housing has a number of brushes 520, 530, 540 and 550 which are of different shapes and styles to allow the personal cleaning device to be configured to meet personal tastes.

Figure 6:
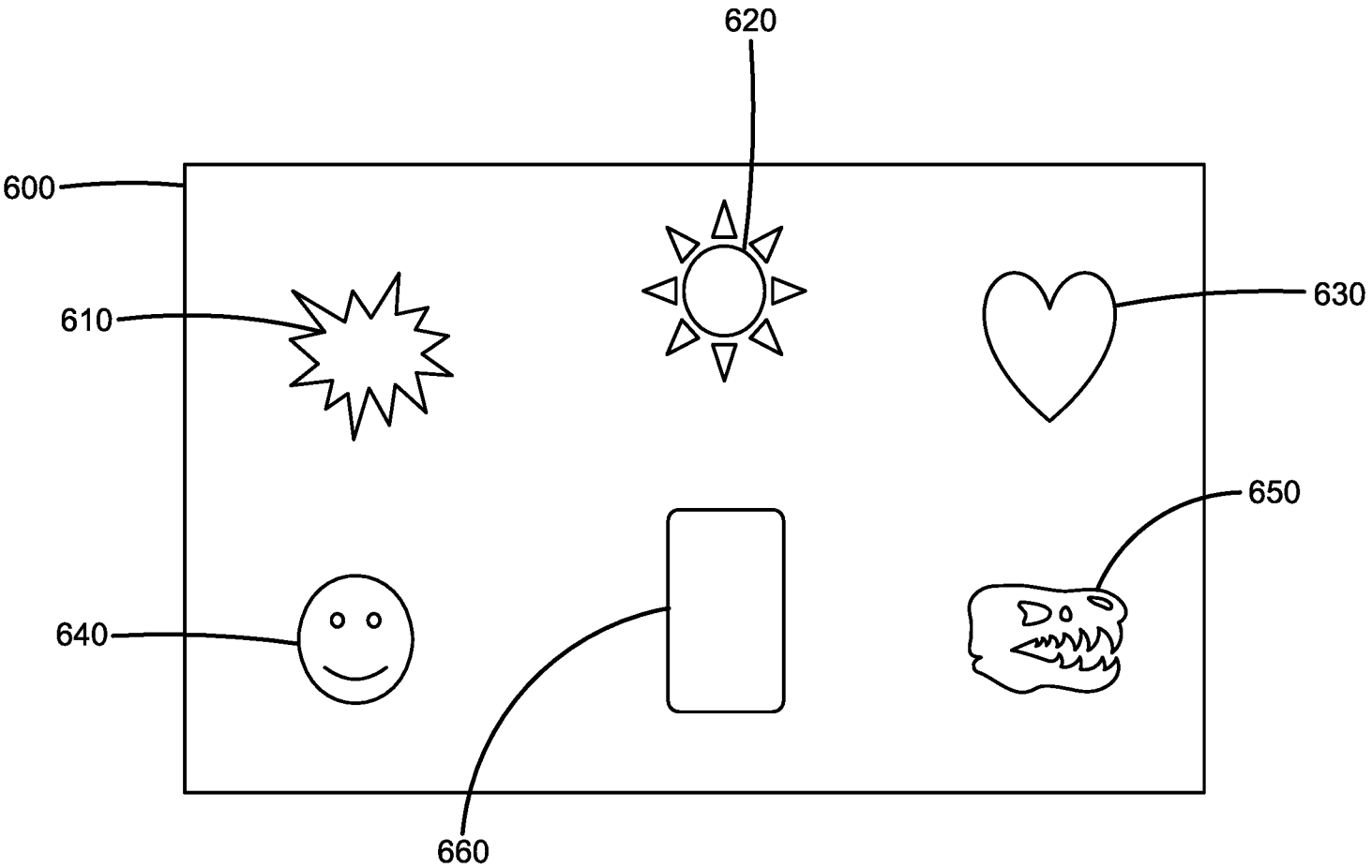
FIG. 6 illustrates a perspective view of one potential embodiment of a personal cleaning device kit of the present invention in accordance with the disclosed architecture.

FIG. 6 shows a kit that may be purchased along with the personal cleaning device. The kit includes a package 600 that contains a number of different brushes or cleaning accessories 610, 620, 630 and 640. The kit 600 also includes a decorative element 650 that may be affixed to the housing of the personal cleaning device. The kit 600 may further include one or more cleaning fluid refills 660 which may be used to refill the cleaning liquid dispenser. The brushes are interchangeable allowing the user to change the brushes as they wear out or to use different brushes having different textures or themes.

It should further be noted that all components of the device 100 are preferably waterproof or water-resistant. All components of the device 100 may further be mold and mildew resistant. In addition, all components of the device 100 are preferably rust resistant.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "back scrubbing device" and "device" are interchangeable and refer to the back scrubbing device 100 of the present invention.

Notwithstanding the forgoing, the personal cleaning or cleansing or back scrubbing device 100 of the present invention and its various components can be of any suitable size and configuration as is known in the art without affecting the overall concept of the invention, provided that they accomplish the above-stated objectives. One of ordinary skill in the art will appreciate that the size, configuration and material of the back scrubbing device 100 as shown in the FIGS. are for illustrative purposes only, and that many other sizes and shapes of the back scrubbing device 100 are well within the scope of the present disclosure. Although the dimensions of the back scrubbing device 100 are important design parameters for user convenience, the back scrubbing device 100 may be of any size, shape and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A personal cleaning device comprising:

a housing comprised of a front surface having at least one brush, a rear surface, a pair of side surfaces, a top surface and a bottom surface;

a motor contained within the housing for powering the at least one brush;

a control panel for operating the motor and the at least one brush; and a battery for powering the motor; and wherein the control panel is in wireless communication with a smartphone to operate the at least one brush.

2. The personal cleaning device of claim 1 further comprising at least one reservoir contained within the housing for holding a cleaning fluid.

3. The personal cleaning device of claim 2, wherein the at least one brush comprises an opening for receiving the cleaning fluid from the at least one reservoir.

4. The personal cleaning device of claim 1 further comprising a plurality of brushes attached to the front surface and driven by the motor.

5. The personal cleaning device of claim 4, wherein each of the plurality of brushes have one of a different texture or size.

6. The personal cleaning device of claim 4, wherein the plurality of brushes are interchangeable with one another.

7. The personal cleaning device of claim 1, wherein the motor drives the at least one brush to rotate and move in a direction.

8. The personal cleaning device of claim 7, wherein the direction is one of a horizontal direction, a vertical direction or a diagonal direction.

9. The personal cleaning device of claim 7, wherein the at least one brush may rotate at different speeds.

10. The personal cleaning device of claim 7, wherein the at least one brush may rotate for a user specified period of time.

11. The personal cleaning device of claim 1, wherein the smartphone is in wireless communication with a speaker.

12. The personal cleaning device of claim 1, wherein the housing comprises an attachment feature allowing the housing to be attached to a surface.

13. The personal cleaning device of claim 1, wherein the housing comprises a deformable or a shaped front surface.

14. A back scrubbing device comprising:

a housing having a front, deformable or shaped surface, a pair of side surfaces, a top surface, a bottom surface and a back surface;

an attachment feature for securing the housing to a surface;

a plurality of brushes positioned on the front surface, wherein the plurality of brushes are rotatable;

a motor for driving the plurality of brushes;

a reservoir for dispensing a cleaning fluid for use with the plurality of brushes;

a control panel for controlling the operation of the plurality of brushes; and a smartphone in wireless communication with the control panel.

15. The back scrubbing device as recited in claim 14, wherein the plurality of brushes are movable in one of a horizontal direction, a vertical direction and a diagonal direction.

16. The back scrubbing device as recited in claim 14, wherein the plurality of brushes are operatable for a user specified period of time and comprise different textures and shapes.

17. The back scrubbing device as recited in claim 14 further comprising a neck extension attached to the top surface of the housing.

18. A back cleaning device comprising:

a housing having a front surface that is deformable;

an extension mounted on a top surface of the housing for cleaning a neck of a person;

a plurality of brushes mounted on the front surface, each of the plurality of brushes mounted for rotational movement;

a reservoir for dispensing a cleaning fluid to the plurality of brushes;

an attachment feature for mounting the housing to a surface; and a control panel connected to a motor for driving the plurality of brushes.

* * * * *